US010285901B2

(12) United States Patent
Godfrey et al.

(10) Patent No.: US 10,285,901 B2
(45) **Date of Patent: *May 14, 2019**

(54) VIBRATING MASSAGE ROLLER

(71) Applicant: Health e Company, Cottonwood Heights, UT (US)

(72) Inventors: Brian P. Godfrey, Salt Lake City, UT (US); Sandra Reboucas, San Diego, CA (US); Theodore B. Hill, San Diego, CA (US); Thomas A. Deiters, San Diego, CA (US)

(73) Assignee: HEALTH E VIBRATIONS, LLC, Salt Lake City, UT (US)

( * ) Notice: Subject to any disclaimer, the term of this patent is extended or adjusted under 35 U.S.C. 154(b) by 311 days.

This patent is subject to a terminal disclaimer.

(21) Appl. No.: 13/915,270

(22) Filed: Jun. 11, 2013

(65) Prior Publication Data

US 2013/0281892 A1 Oct. 24, 2013

Related U.S. Application Data

(63) Continuation-in-part of application No. 12/614,304, filed on Nov. 6, 2009, now Pat. No. 8,500,663.
(Continued)

(51) Int. Cl.
*A61H 15/00* (2006.01)
*A61H 23/00* (2006.01)
(Continued)

(52) U.S. Cl.
CPC ..... *A61H 23/02* (2013.01); *A61H 1/00* (2013.01); *A61H 15/0078* (2013.01);
(Continued)

(58) Field of Classification Search
CPC ..... A61H 23/0254; A61H 23/0263; A61H 15/0085; A61H 2023/0272;
(Continued)

(56) References Cited

U.S. PATENT DOCUMENTS 1,723,268 A * 8/1929 Conill ..... A61H 23/0263 601/72
1,936,022 A 11/1933 Hunt
(Continued)

FOREIGN PATENT DOCUMENTS

| | | |
|---|---|---|
| CN | 101671864 | 3/2010 |
| WO | 2004067364 | 8/2004 |
| WO | WO 2004067364 | 8/2004 |

OTHER PUBLICATIONS

Katz, Anthony "Hyperice-Kickstarter", 2 pages; © 2015; https://www.kickstarter.com/profile/74007868; website Hyperice.com.
(Continued)

*Primary Examiner* — Michael J Tsai
*Assistant Examiner* — Christopher E Miller
(74) *Attorney, Agent, or Firm* — Avery N. Goldstein; Blue Filament Law PLLC

(57) ABSTRACT

A process of massaging a subject is provided that includes the provision of a vibratory massage roller having a casing with a casing surface extending over a length of the vibratory roller. A motor in included in the housing and is electrically coupled to a power source. The power source is energized to induce a vibratory amplitude to the surface that varies less than 30 amplitude percent across the central 70 percent of the length. The massage roller is contacted with the subject to massage the subject.

3 Claims, 9 Drawing Sheets
(1 of 9 Drawing Sheet(s) Filed in Color)

Related U.S. Application Data

(60) Provisional application No. 61/111,961, filed on Nov. 6, 2008.

(51) Int. Cl.
*A61H 23/02* (2006.01)
*A61H 1/00* (2006.01)

(52) U.S. Cl.
CPC ..... *A61H 2015/0014* (2013.01); *A61H 2015/0071* (2013.01); *A61H 2023/0272* (2013.01); *A61H 2023/0281* (2013.01); *A61H 2201/1207* (2013.01); *A61H 2201/5043* (2013.01)

(58) Field of Classification Search
CPC .... A61H 2023/0281; A61H 2201/0142; A61H 2201/5002
See application file for complete search history.

(56) References Cited

U.S. PATENT DOCUMENTS 2,213,482 A * 9/1940 Avery ..... A61H 15/0085 601/120
2,425,655 A 8/1947 Tompkins
2,466,470 A 4/1949 Norris
2,523,547 A * 9/1950 Zerkle ..... A61H 23/0263 601/15
2,539,712 A 1/1951 Wettlaufer
2,604,091 A 7/1952 Hansen
2,675,800 A * 4/1954 Voorhees et al. ..... A61H 23/0263 601/72
2,786,465 A * 3/1957 Moxley ..... A61H 23/0254 310/81
2,821,191 A * 1/1958 Paii ..... A63J 17/00 381/333
2,904,036 A 9/1959 Thomas
2,924,216 A * 2/1960 Stewart ..... A61H 23/0263 601/60
2,943,621 A 7/1960 Phillips et al.
3,064,642 A * 11/1962 Stewart ..... A61H 23/0263 601/60
3,092,099 A * 6/1963 Berard ..... A61H 23/0263 601/58
3,322,116 A 5/1967 Murphy et al.
3,363,623 A * 1/1968 Atwell ..... A61H 23/0263 601/72
3,464,405 A * 9/1969 Kallus ..... A61H 23/0263 601/57
3,580,245 A * 5/1971 Dill ..... A61H 23/0254 601/57
3,580,246 A * 5/1971 Foreman ..... A61H 23/0263 601/72
3,831,591 A * 8/1974 Newkirk ..... A47C 7/72 601/58
3,896,795 A * 7/1975 Solhkhah ..... A61H 23/0254 601/46
3,981,032 A 9/1976 Brooks
3,996,929 A 12/1976 Mabuchi
4,005,703 A * 2/1977 Rosen ..... A61H 2201/0138 601/57
4,081,870 A 4/1978 Iannucci
4,198,962 A 4/1980 McCauley
4,347,838 A 9/1982 McCauley
4,559,929 A * 12/1985 Hseu ..... A61H 23/0263 366/111
4,722,326 A 2/1988 Ruderian
4,878,489 A * 11/1989 Kamayachi ..... A61H 23/0263 601/72
4,947,832 A 8/1990 Blitzer
5,007,410 A * 4/1991 DeLaney ..... A47C 21/006 5/694
5,330,416 A 7/1994 Masuda et al.
5,374,238 A 12/1994 Xiao
5,393,287 A 2/1995 Papapaschalis
5,393,297 A * 2/1995 Kristoff ..... A45D 19/10 4/523
5,437,607 A * 8/1995 Taylor ..... A61H 1/00 5/915
5,471,103 A 11/1995 Fujii
5,545,125 A * 8/1996 Tseng ..... A61H 23/0263 601/70
5,554,102 A * 9/1996 Chiou ..... A61H 15/0092 601/118
5,824,013 A 10/1998 Allen
5,830,161 A 11/1998 Cosmano
5,833,635 A 11/1998 Aboud, Sr.
5,868,653 A * 2/1999 Klasen ..... A61H 23/0263 482/108
5,902,256 A * 5/1999 Benaron ..... A61H 23/0263 601/108
6,039,702 A * 3/2000 Cutler ..... A61H 23/0263 601/15
6,056,357 A * 5/2000 Fukuoka ..... B60N 2/502 297/217.3
6,203,470 B1 3/2001 Lundin et al.
6,309,331 B1 10/2001 Raymond
6,468,236 B1 10/2002 Sumanac
6,505,361 B1 1/2003 Hayashibara
6,505,661 B1 1/2003 Ogawa
6,647,572 B2 11/2003 Lee
6,702,766 B2 3/2004 Guitay
7,087,004 B1 8/2006 Berke
7,297,126 B2 * 11/2007 Kries ..... A61H 23/00 5/915
8,556,837 B1 10/2013 Poirier
D714,952 S 10/2014 Gonglach et al.
9,968,513 B1 5/2018 Marton et al.
2003/0131414 A1 * 7/2003 Lee ..... A47C 20/021 5/632
2003/0131416 A1 * 7/2003 Lee ..... H01L 31/022408 5/652
2004/0267173 A1 12/2004 Mangano
2005/0033203 A1 2/2005 Son
2005/0070827 A1 * 3/2005 Lee ..... A61H 23/0263 601/57
2006/0270954 A1 11/2006 Tumey
2008/0070210 A1 3/2008 Hitzmann
2008/0200851 A1 8/2008 Faussett
2008/0214969 A1 9/2008 Milne et al.
2009/0176635 A1 * 7/2009 Brinson ..... A61H 7/001 482/141
2010/0113992 A1 5/2010 Godfrey et al.
2010/0274162 A1 10/2010 Evans
2012/0310125 A1 12/2012 Hall et al.
2013/0281892 A1 10/2013 Godfrey et al.

OTHER PUBLICATIONS

Gonglach, Mark "RollingFWD High-Tech Vibrating Foam Roller" Nov. 20, 2015; 6 pp.; https://www.kickstarter.com/projects/951900514/rollingfwd-high-tech-vibrating-foam-roller.

* cited by examiner

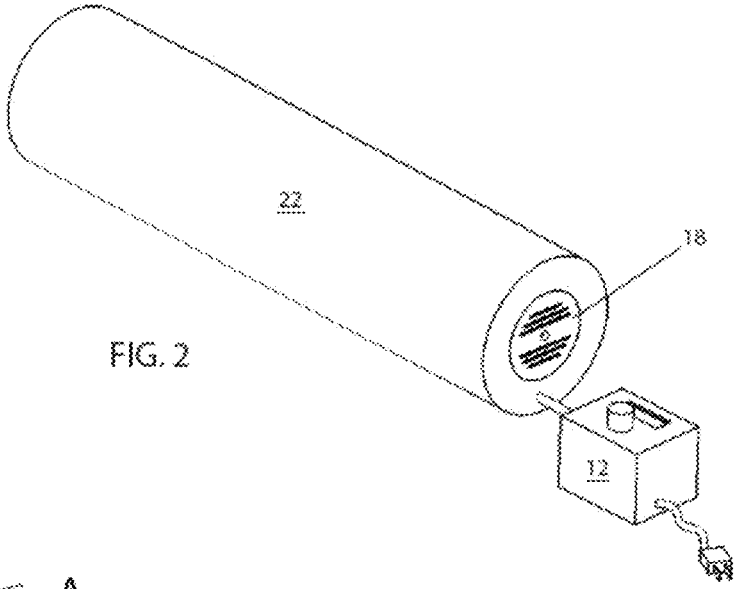
FIG. 2
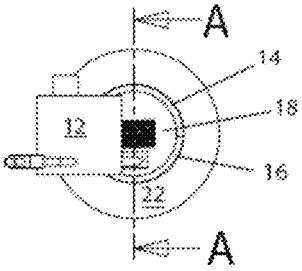
FIG. 3
FIG. 4
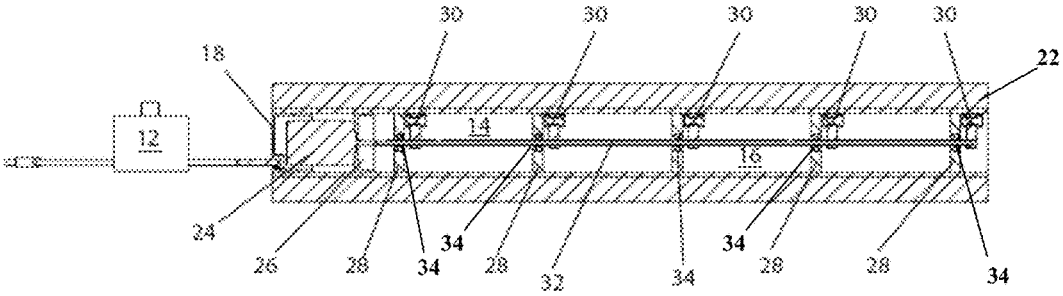

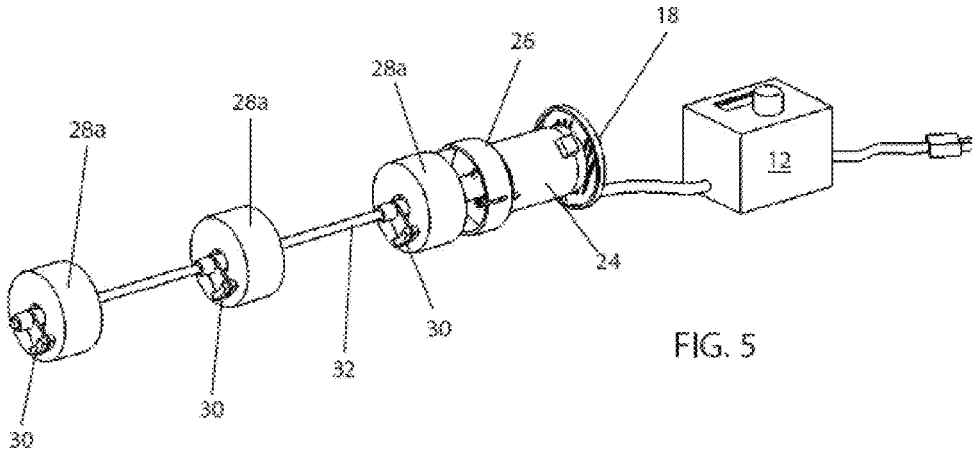
FIG. 5
FIG. 6A
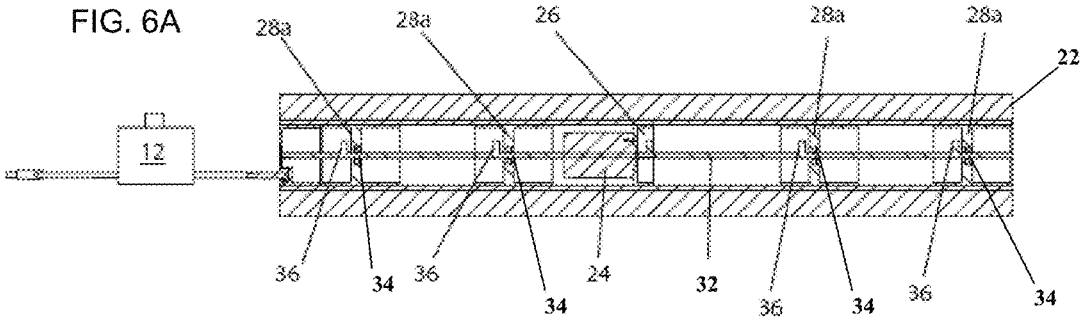

VIBRATING MASSAGE ROLLER

CROSS-REFERENCE TO RELATED APPLICATION

This application is a continuation in part of U.S. patent application Ser. No. 12/614,304 filed Nov. 6, 2009, now U.S. Pat. No. 8,500,663 B2 that in turn claims priority benefit of U.S. Provisional Application 61/111,961, filed Nov. 6, 2008, the contents of which are hereby incorporated herein by reference.

FIELD OF THE INVENTION

The present invention relates to the field of massagers and more particularly relates to a massage roller that affords a level of uniformity of vibration to a subject along the length of the roller.

BACKGROUND OF THE INVENTION

Massage is the manipulation of subject muscles and soft tissues in order to affect a release of tension. Massage involves many strategies, including kneading and stretching muscles, percussive striking, and vibration. Massage is well known in the fields of medicine, chiropractic, physical therapy, kinesiotherapy and fitness. Massage is practiced universally around the globe, both professionally and personally, and is recognized as providing some benefits to the mental, emotional and physical health of those receiving it.

In light of the almost universal appeal and recognition of massage, many different styles of massage have been developed, ranging from Shiatsu, Swedish, Deep Tissue, and others, and tools to aid in massage have developed in each discipline. One such tool is known as a massage roller or foam roller. Foam Rollers are cylindrical or semi-cylindrical bodies made of a compliant material, such as foam, which are used for massaging and stretching soft tissues, increasing circulation, reducing pain, tension and stress from the soft tissues, improving posture and alignment, increase spinal mobility. Core and corrective exercises can be used with the roller as well.

Prior art solutions that use eccentric weights rotating about an axle fail to evenly distribute vibrations to a roller or other massager surface as they generally have only two contact points, one at the motor and one at or by a terminal end of the axle. This localizes all vibrational transmission at those two end points and can cause "weak spots" or "dead zones" along the length of a massager apparatus, especially if they are improperly spaced and allow destructive interference between the two points of contact. This spatial disparity in vibrational amplitude is a result of construction method with a motor and an eccentric weight mounted to a shaft extending from the motor to define a cylindrical axis. Stronger vibrations are created proximal to the weight with the vibrational amplitude decaying as a functional of lateral distance from the eccentric weight. As a result, when the weight is at one end of the roller, vibrations will dissipate inward from the weighted end along the length of the roller, whereas, a centrally located weight has vibrations that will still dissipate towards the ends. This vibrational amplitude decay is especially noticeable in longer rollers.

The use of several motors along a roller coupled to eccentric weights to alleviate these problems has met with limited success and also creates harmonic vibrating waves that tend to create points of low amplitude strength vibrations at certain positions along the roller with the position in part dictated by the rotational rate. Exemplary of these efforts is U.S. Pat. No. 6,647,572 in which vibratory nodes are partially mitigated and may be more evenly distributed, yet the reliance on several motors increases cost, weight, and device proclivity to breakage. The problems posed by motor failure are enhanced by the fact that the motor is generally inaccessible for repair and effectively encased in a surrounding roller material. Still another attempt to address the problem of vibrational amplitude inhomogeneity along the length of the roller involves mounting multiple eccentric weights along a single rotating shaft; however, this tends to either accentuate the inhomogeneity if the weights are radially aligned or if radially distributed around the shaft, torque is imparted to the motor that leads to motor damage.

Thus, there exists a need for a vibrating massage roller that provides a degree of positional uniformity in vibration along the roller imparted to a subject in contact with the roller.

SUMMARY OF THE INVENTION

A process of massaging a subject is provided that includes the provision of a vibratory massage roller having a casing with a casing surface extending over a length of the vibratory roller. A motor is included in the housing and is electrically coupled to a power source. The power source is energized to induce a vibratory amplitude to the surface that varies less than 30 amplitude percent across the central 70 percent of the length. The massage roller is contacted with the subject to massage the subject.

In some embodiments, the motor is a reciprocating motor and also includes a rod mechanically coupled to the reciprocating motor and to a piston mounted in a stiff center tube; and an expandable outer tube surrounding and in fluid communication with the stiff center tube; such that the piston moves along a longitudinal axis of the massage roller and pushes a fluid from a first region in the stiff center during a forward stroke and inflates a second region encompassed by said expandable outer tube, and in a reverse stroke the piston retracts the fluid is drawn back into the internal stiff tube inducing the second region to constrict. In other inventive embodiments, beveled gears are present in the casing that impart counter rotations to a first and a second mass are provided in mechanical communication the motor. In still other inventive embodiments, rotating drum rollers are supported and arranged along the circumference of two or more rotating bulkheads and mechanically coupled to the motor, the rotating bulkheads rotating about a central axial support in the casing. The axial support is fixedly attached to end supports, where the end supports have a larger diameter than the rotating bulkheads. In still another embodiment, a shaft extends from the motor within the casing. Multiple eccentrically positioned weights and a supports that are so positioned along said shaft.

BRIEF DESCRIPTION OF THE DRAWINGS

The file of this patent contains at least one drawing/photograph executed in color. Copies of this patent with color drawing(s)/photograph(s) will be provided by the Office upon request and payment of the necessary fee. The subject matter that is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

FIG. 2 is a perspective view of the massage roller of FIG. 1, with an optional covering sleeve;

FIG. 3 is a front elevation of the massage roller of FIG. 2;

FIG. 4 is a sectional view of the massage roller of FIG. 3, taken along line A-A;

FIG. 5 is a perspective view of the internal structure of a massage roller according to an alternate embodiment of the invention;

FIG. 6A is a sectional view of a massage roller according to a still further embodiment, along the same line as FIG. 4;

DESCRIPTION OF THE PREFERRED EMBODIMENTS

Figure 1:
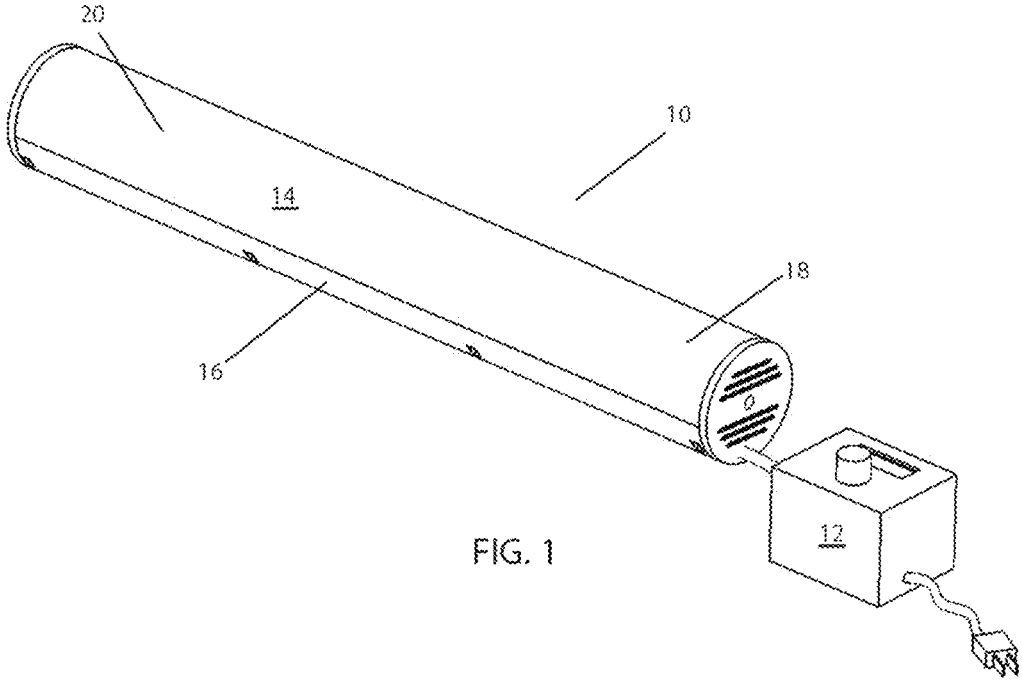
FIG. 1 is a perspective view of a massage roller according to one embodiment of the invention.

The present invention has utility as a vibratory massage roller to facilitate muscle relaxation in a subject. Representative applications of the present invention include massage, physical therapy, yoga, physical conditioning, and general well-being.

In view of the foregoing disadvantages inherent in the known types of massagers, this invention provides a more efficient process for massaging a subject through resort to a vibrational roller having a casing with a casing surface extending over a length of the vibratory roller, and a motor in the housing that is electrically coupled to a power source. The power source is energized to induce a vibratory amplitude to the surface that varies less than 30 amplitude percent across the central 70 percent of the length of the roller. In some embodiments, the vibratory amplitude is controlled to between 5 and 25 amplitude percent across the central 70 percent of the length of the roller at operational speeds for subject massage. In still other embodiments, the vibratory amplitude is controlled to within 10 amplitude percent across the central 70 percent of the length of the roller at operational speeds for subject massage.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

With reference now to the drawing, the preferred embodiment of the vibrational roller is herein described. It should be noted that the articles "a", "an", and "the", as used in this specification, include plural referents unless the content clearly dictates otherwise.

The present invention represents a departure from the prior art in that the process of massage is enhanced by contacting an energized massaging roller of the present invention with a subject that allows for more even distribution of vibrations, In certain embodiments, this is accomplished by utilizing a plurality of eccentric weights and supports that are positioned at different points along a shaft parallel to the axis of the cylinder and are synchronized and positioned for maximum vibrational efficiency. By utilizing a plurality of strategically placed eccentric weights and strategically placed supports, the vibrations engage in reinforcing behavior as they travel the length of the roller, which keeps vibrations uniform throughout the roller, even in a longer one. By using one motor and one axle, there are fewer parts and less chance of malfunction and easier to replace or fix when malfunction does occur. Two synchronized, cooperating motors may be used in an alternate embodiment of the invention. The roller may be made in various sizes. Roller length typically is from 12 to 36 inches and circumference may vary from 3 to 10 inches. The roller should be able to resist up to 350 pounds of pressure. In particular embodiments that include eccentric weights, individual weights may be separate pieces or may be a weighted portion integral with a central rotational shaft. Additionally, it is appreciated to any of the embodiments of the present invention, a thermoelectric resistive heater is readily added to introduce heat and vibration to muscle tissue that is being treated, either through incorporation into the casing or a covering sleeve. Likewise a cooling system is also readily provided a chemical cold pack such as those based on urea, a cool pack based on freeze/thaw cycling; or a thermoelectric Peltier refrigerator, either through incorporation into the casing or a covering sleeve.

It is to be understood that in instances where a range of values are provided that the range is intended to encompass not only the end point values of the range but also intermediate values of the range as explicitly being included within the range and varying by the last significant figure of the range. By way of example, a recited range of from 1 to 4 is intended to include 1-2, 1-3, 2-4, 3-4, and 1-4.

An embodiment of an inventive roller shown generally in FIGS. 1-6 at 10. The roller 10 has tubular casing portions 14 and 16 that define a hollow center. It is appreciated that the casing portions 14 and 16 as shown are symmetric and define casing halves; however, in other embodiments one casing portion defines 270 to 340 degrees of the radial distance around the center, with the other casing portion acting as an access door to the center volume. While the tubular casing is depicted herein as a right cylinder, it is appreciated that other cross-sectional shapes are operative herein that include oval, triangular, square, pentagonal, hexagonal and higher polygonal shapes. Resident inside the center, is a shaft (synonymously referred to herein as an "axle") 32 mounted between a thrust bearing 26 and a motor 24. A coupling may be used to couple the shaft 32 to the motor 24 or the shaft 32 may connect directly to the motor 24 as shown in the figures. Supports 28 are provided to provide linkage between the casing portions 14 and 16 and the shaft 32. Bearings 34 provide a rolling surface, and thus reduced friction, to the shaft 32. A plurality of eccentric weights 30 are positioned along the shaft 32. These weights 30 are each a different length from the motor 24, or from a chosen reference point that is on the shaft 32. The weights 30 are eccentrically mounted, meaning that their center of mass is not positioned on the shaft 32 itself, but rather radially displaced some distance, x, away from the axis of rotation of the shaft 32. Thus, when the shaft 32 rotates along its axis, the weights 30 circumscribe a circular motion about the axis and impart a wobble to the shaft 32. This wobble is transmitted to the casing portions 14 and 16 through the supports 28. When a sufficient rotational speed measured for example in revolutions per minute (RPM) are reached, the wobble causes a strong vibration transmitted throughout the casing portions 14 and 16. The weights 30 and supports 28 are strategically positioned about the shaft 32 so as to provide maximum synchronous and uniform vibration advantage during rotation, which is to say they are positioned in a manner to provide a uniform vibrational profile throughout the shaft 32 and entire roller 10. The positioning of the weights and supports is of paramount importance as these structures actually impart the uniform vibrational profile to the surface of the roller. Through proper positioning of these weights and supports, vibrations at the surface of the roller will have uniform strength along the length of the roller, with no "dead" or "weak" spots where vibration is not present due to destructive wave interference. The supports 28 and the weights 30 are shown in FIGS. 1-5 with each weight being distal to an adjacent support 28; however, it is appreciated that the relative spacing between a support 28 and the distal weight 30 and indeed, the mass and radial displacement of a given weight are amenable to adjustment to achieve a vibratory amplitude to the surface that varies less than 30 amplitude percent across the central 70 percent of the length of the roller.

Control of the motor 24, and thus the vibration, is achieved through control unit 12, which may be a separate unit as shown in the figures or positioned on the forward end cap 18, which seals one end of the roller 10. The other end is sealed by a second end cap 20. Control unit 12 may have different switches to alter the vibrational characteristics by adjusting the rotational characteristics of the motor 24. Such alterations are principally through control of motor rotational speed to set up higher harmonics of vibration that modify the frequency and amplitude of the vibration imparted to a subject in contact with an inventive roller surface. Communication of changes may be displayed on an LCD screen or through indicia as to setting of for example "off", "low" and "high".

A number of alternative embodiments are possible to achieve the desired a vibratory amplitude to the surface that varies less than 30 amplitude percent across the central 70 percent of the length of the roller. The first alternative embodiment would be to utilize a pair of cooperative motors, one located on either end of the shaft 32 or both motors in center of tube. The control unit 12 could then activate one or both motors simultaneously or alternatively in a manner to lessen wear on each motor individually, thus prolonging motor life. Multiple motors could be used, each with different shafts and different sets of weights.

Figure 7:
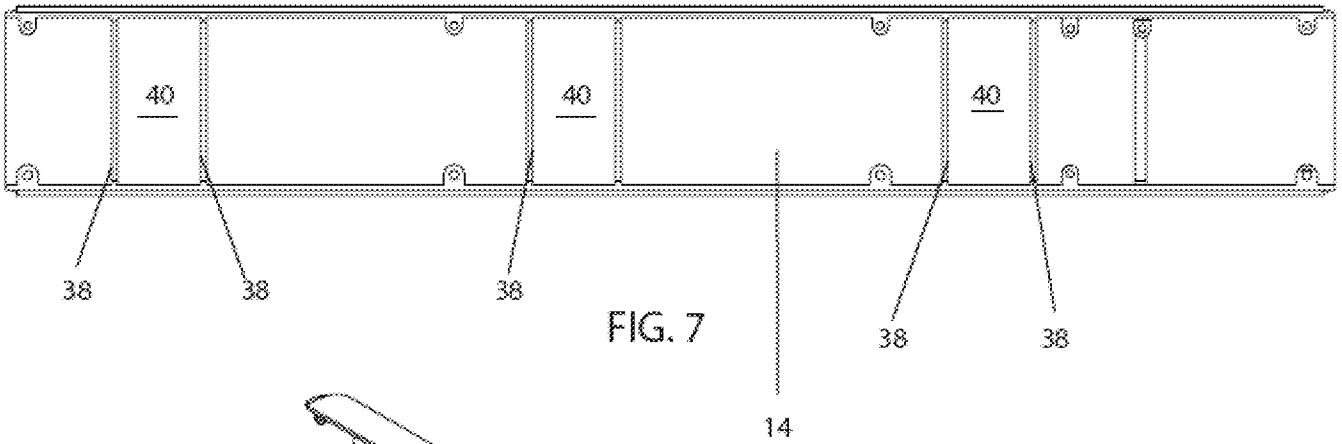
FIG. 7 is an elevation of first portion of a longitudinally divided casing used in the present invention.
Figure 8:
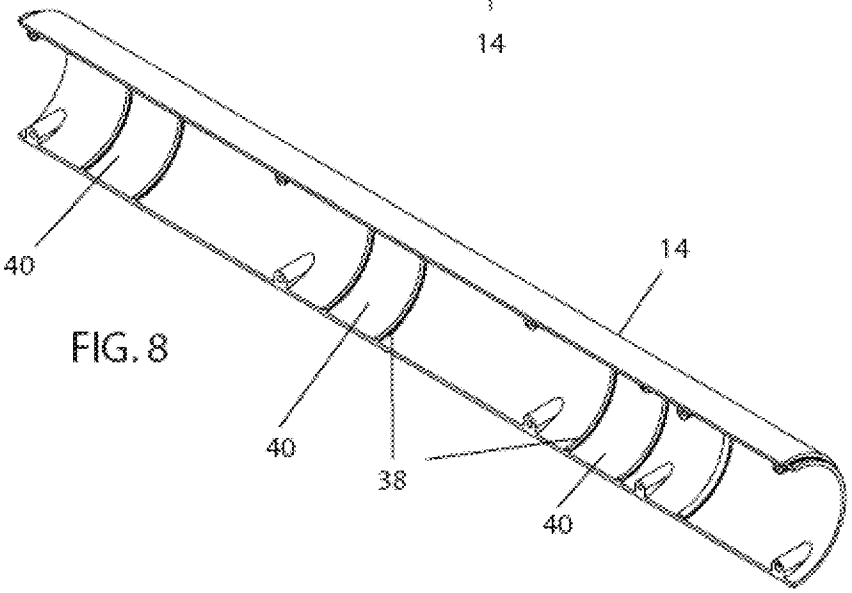
FIG. 8 is a perspective view of the first portion of casing of FIG. 7.

As shown in FIG. 5, the broad supports 28*a* are broader than supports 28 as depicted in FIG. 4. It is appreciated that a single embodiment readily incorporates supports of varying widths, such as supports 28 and 28*a* and energy transmissive properties. Weights may be separate pieces 30 or may be a weighted portion 36 integral with the shaft 32, shown in FIG. 6. Another alternative would be to have a number of shafts, each of different length, extending from the same motor and having one or more eccentric weights mounted thereon. Ideally these would be along the same axis and then could even be a single axle passing through the motor 24 as shown in FIG. 6A. Separate axles may be used which have different axes, and positioning them and weights about them for maximum effect, namely the even distribution of vibrations to the surface of the roller, would be a mathematical calculation that could be ascertained with not much difficulty and would involve the length and mass of the axle and roller as whole, moment of inertia of the axle and weights, rotational frequency and other factors. FIGS. 7 and 8 illustrate an interior surface of the roller casing. The casing portions 14 and 16 are readily formed from a variety of thermoplastic, and metal materials. These materials illustratively include polyvinyl chloride, acrylonitrile butadiene styrene, acetal homo- and co-polymers, polyamides, polyacrylates, polyacrylics, polycarbonate, polyethylene, polypropylene, polystyrene, polyurethane; aluminum, steel, powder metal, or combinations thereof. Detents 40 are provided to secure supports 28 within the casing 14 (and similarly on the other casing portion 16 which is not shown as it is redundant). Detents could be grooves formed within the casing or may each be a pair of ribs 38, as depicted, or any other similar structure. The detents 40 provide a more positive interaction of the supports 28 with the casing, when assembled. This increases efficiency of vibrational transmission and helps secure the supports in their intended position along the axle 32. It is appreciated that detents are also applicable to other embodiments of an inventive roller described herein and the process of massage enabled by the roller.

Figure 6B:
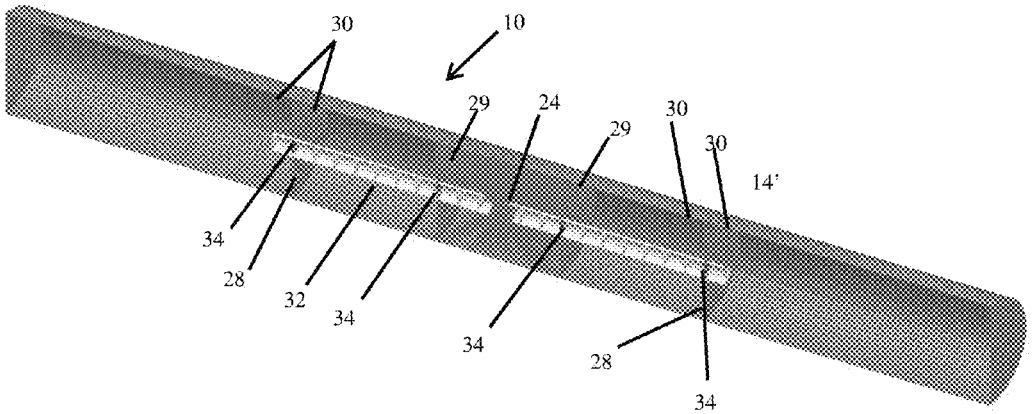
FIGS. 6B and 6C are a depiction of a finite element analysis of another inventive embodiment of a symmetrical massage roller, along the same line as FIG. 4.
Figure 6C:
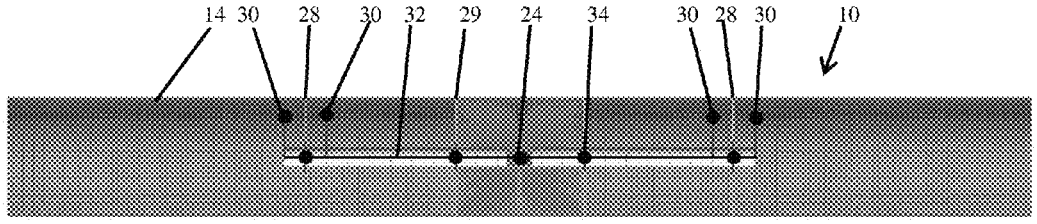

FIGS. 6B and 6C are a depiction of a finite element analysis of an inventive embodiment of an inventive massage roller 31 similar to that shown in FIG. 6A where like elements have the same numbers as previous embodiments. The inventive design 31 incorporates symmetric weight distribution along the length of the tube to provide translational rigid body motion of uniform amplitude. A motor 24 is centered midspan and mounted in tubular casing portions 14' and 16' between bulkhead motor supports 29 that rotate eccentric masses 30 on both sides. Shaft 32 extends from both sides of the motor 24 and is supported by bearings 34 located on bearing bulkheads 28 and bulkhead motor supports 29. In a certain embodiment, four 25 gram eccentric masses, that are offset one inch from the rotating drive shaft 32 that provides uniform vibration from 20-4000 Hertz (Hz). Continuing with the specific embodiment, the tube has a three inch to 3.5 inch diameter. Increasing tube diameter will further improve uniformity of vibration. This is especially true when the roller has a length of twenty four inches or longer with a wall thickness of 0.05 to 0.25 inches for a thermoplastic casing. In other embodiments of the present invention, the tube diameters are 3.5 inches to 10 inches. In certain embodiments, a 0.125 to 3 inch thick rubber sleeve is placed over the hard tube casing formed by portions 14 and 16. The rubber sleeve is readily formed of materials that illustratively include polynorborene, vinyl rubbers, natural rubbers, and foamed versions of any of the aforementioned rubbers. In certain embodiments, an eleven inch drive shaft that is 6-7 mm in diameter is used and is formed of steel.

In use, about the casing portions 14 and 16 is an exterior sleeve 22 (FIG. 2) made of a durable, yet deformable material, such as foam rubber or cloth so as to impart a pleasing surface which will efficiently and effectively transmit vibrations and to provide impact resistance, sound dampening, and electromagnetic insulation. As used herein, the term "exterior sleeve" is intended to encompass conventional layers overlaid onto the casing that are either permanent or replaceable overlayers. It is appreciated that multiple such sleeves, each of like or varying material is used simultaneously. An effective layer of such material should be between 0.25 and 3 inches thick, depending upon the size of the roller and internal vibrational motor. The tube may be inserted in padded sleeves of varying textures, density and softness for desired effect on vibration or sensation. Sleeve thickness will be between 1 and 3 inches, depending upon desired effect and materials. This will then impart 2 to 6 inches to the diameter of the roller. The use of sleeves is preferable as the sleeves may be made to be washable, an important feature in clinical use, and can provide protection of the roller unit from elements and wear and tear. Individual sleeves may also be provided for varying textures, support, and firmness and also can be used to provide thermal variation for therapeutic use. It is appreciated that the firmer the rubber sleeve, the more deep tissue massage. It is also appreciated that the sleeve is readily wrapped around the casing and attached thereto through hook and loop fasteners, snapping fittings, a zipper or a pressure fit.

Figure 9A:
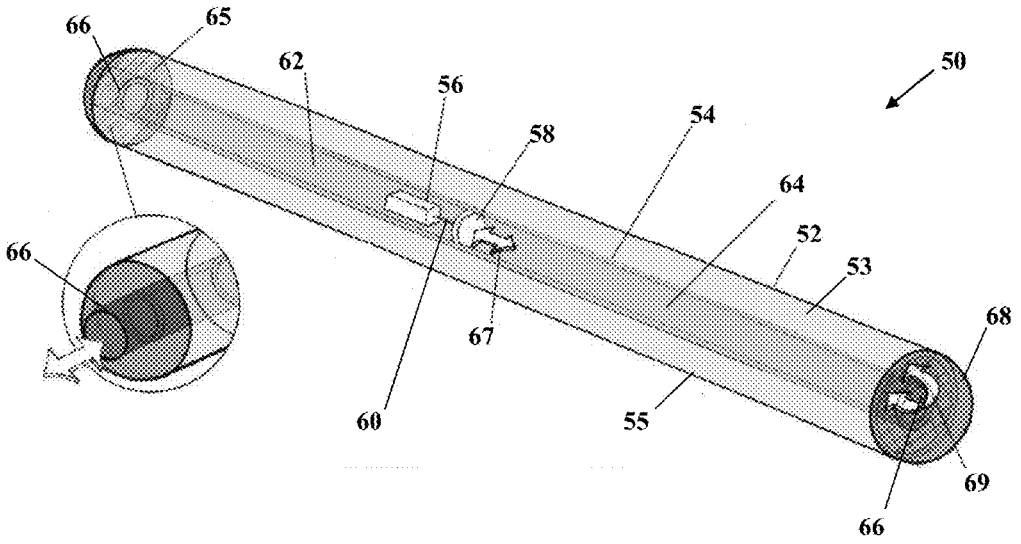
FIGS. 9A-9C are a partially transparent perspective view (FIG. 9A) with an inset showing on opposing view of the distal end as shown; a longitudinal cross-sectional view of an inventive embodiment of a pulsating inflating massage roller with a reciprocating piston in a deflated state (FIG. 9B) and a longitudinal cross-sectional view of an inventive embodiment of a pulsating inflating massage roller with a reciprocating piston in inflated state (FIG. 9C)
Figure 9B:
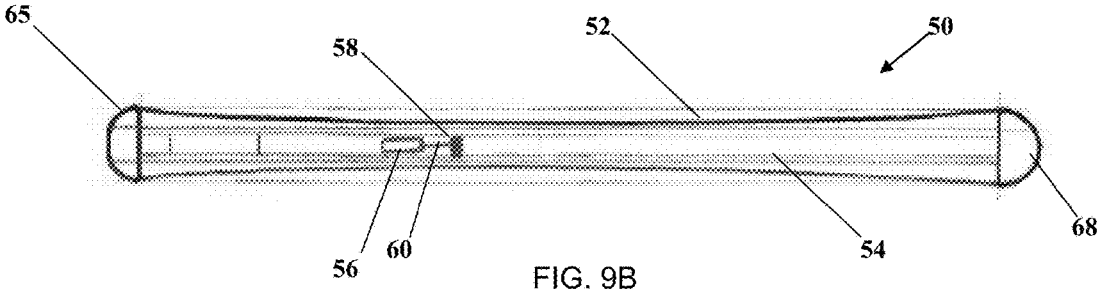
Figure 9C:
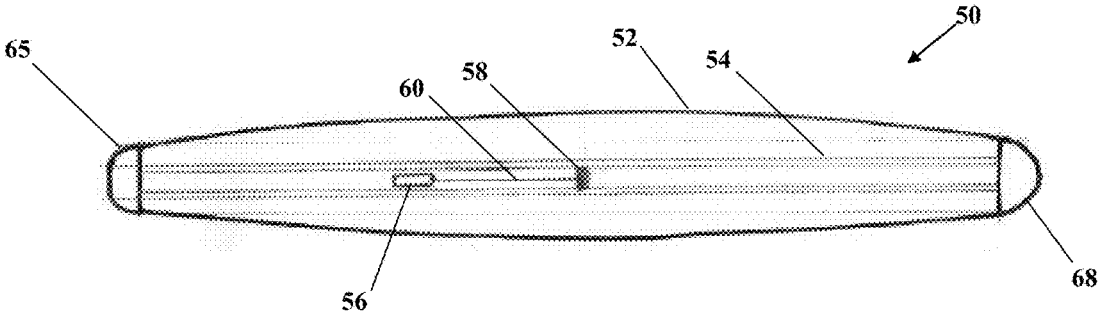

FIGS. 9A-9C are sectioned views of an inventive embodiment of a pulsating inflating massage roller 50 with a reciprocating piston 58 that moves fluid from an internal stiff tube 54 into an expandable outer tube 52, or draws fluid into the stiff tube 54 from the expandable outer tube 52. The reciprocating piston 58 is connected to a motor 56 via rod 60. The stiff inner tube 54 is readily formed of the aforementioned materials from which the casing portions 14 and 16 are fashioned. The term "stiff" as used with respect to inner tube 54 is relative to the outer tube 52 and is defined herein as a smaller material displacement for a given force loading relative to the outer tube 52. In operation, the piston 58 moves along the longitudinal axis of the massage roller 50 and pushes air from region 64 that creates increased air pressure during a forward stroke. The air exits the internal stiff tube 54 at opening 66 as shown by bidirectional arrow 69 at end cap 68, and enters expandable region 53 of outer tube 52. The wall 55 of the outer tube 52 is made of elastomeric materials which expands as fluid is pushed into the expandable region 53 (convex shape), as is shown in FIG. 9C. Conversely in FIG. 9B, as the piston 58 retracts on a reverse stroke, air is drawn back into the internal stiff tube 54 with a vacuum like action via opening 66, and expandable region 53 deflates and constricts slightly (concave shape). End cap 65 is impermeable to expandable region 53, with opening 66 extending to the atmosphere through end cap 65.

The frequency and amplitude (length of piston travel) of motion of the reciprocating piston 58 control frequency and amplitude of vibration at surface 55. In a specific embodiment of the pulsating inflating massage roller 50, atmospheric pressure is maintained in region 62 that lies in the stiff inner tube 54 opposite the side of the motor 56 that drives the piston 58, while the inflation pressure varies from 15-60 psi in the region 64 side of piston with approximately two inches of piston lateral extension. It is noted that deformation of the massage roller 50 is exaggerated in FIGS. 9B and 9C for illustrative purposes. In a specific embodiment of the massage roller 50, the piston 58 driven at 5 to 100 Hz. In specific embodiments of the pulsating inflating massage roller 50, the amplitude and frequency of vibration are controlled independently by changing the stroke or frequency of the reciprocating piston 58. In specific embodiments the fluid air, a purified gas, water, hydraulic fluid, brake fluid, or a gelled polymer.

Figure 10A:
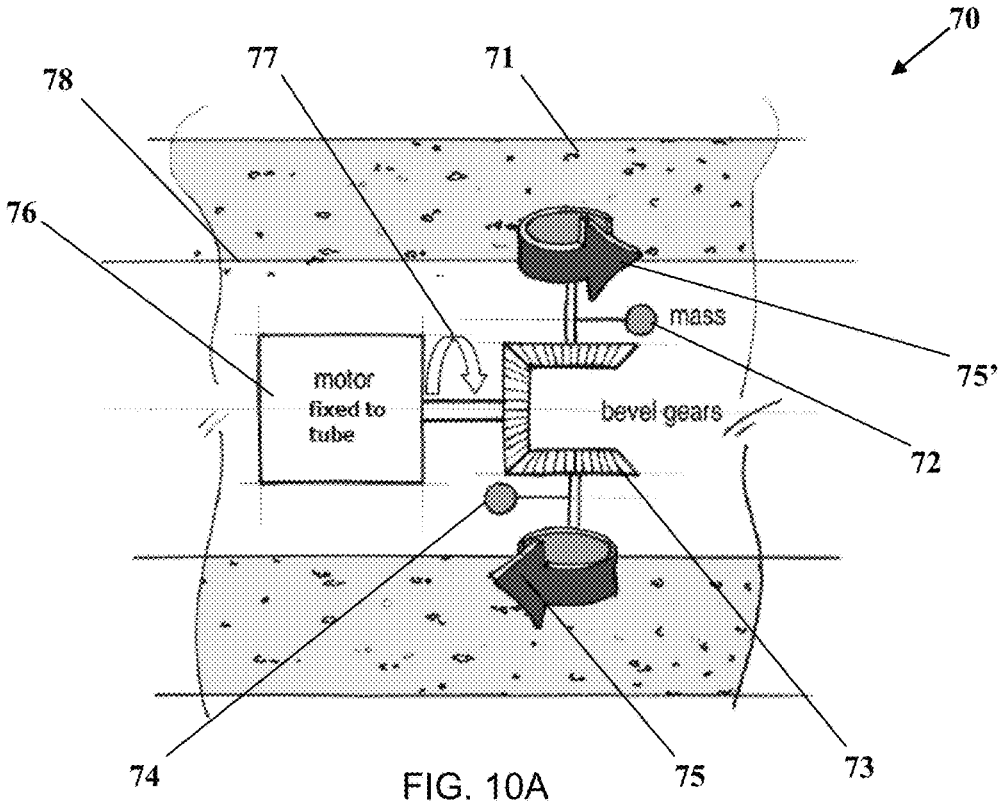
FIGS. 10A and 10B are longitudinal cross-sectional view of an inventive embodiment of a an inventive massage roller with counter rotational masses that are imbalanced to create linear vibration through rotation of motor driven bevel gears; and transverse cross-sectional views of the embodiment depicted in FIG. 10A that sequentially vary as gear mounted masses are rotated around various axes.
Figure 10B:
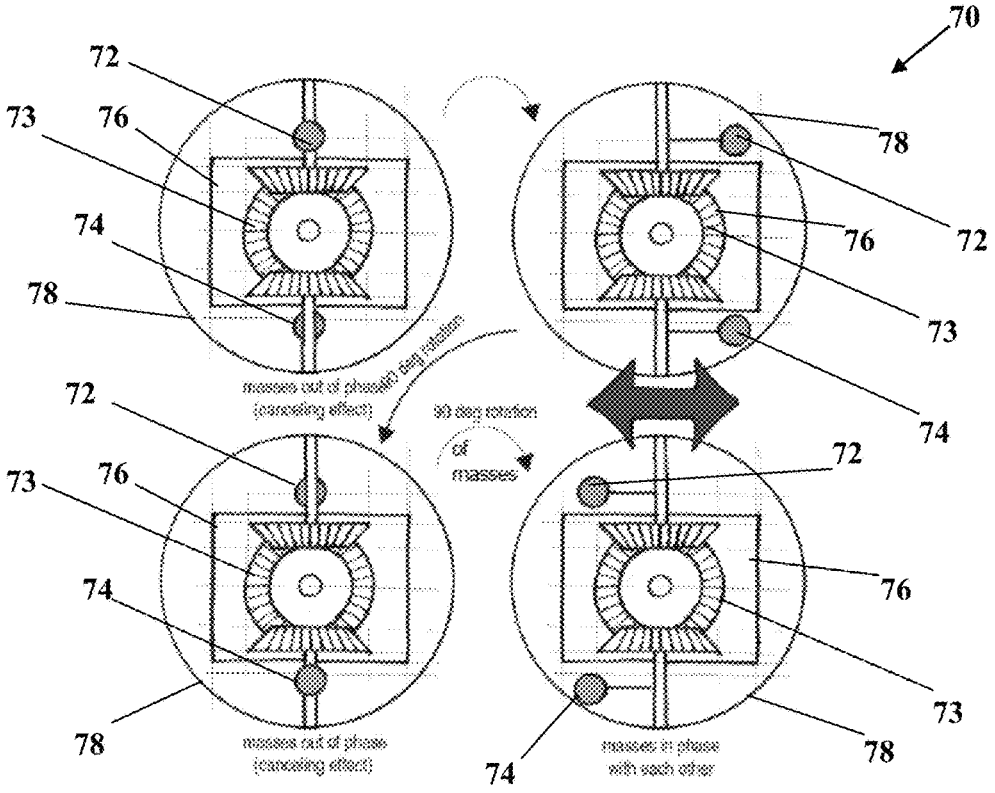

FIGS. 10A and 10B are sectional top and end views, respectively, of an inventive massage roller 70 with counter rotational masses 72 and 74 that are imbalanced to create linear vibration in the massage roller 70. A motor 76 is fixed to a solid hollow tube 78, and drives a set of bezel gears 73 to impart a counter rotation (illustrated by arrows 75 and 75' to the masses 72 and 74. As shown, the configuration of the masses 72 and 74 would create a vibration in and out of the page. Rotation of the entire motor 76 and gear set 73 in tube 78 by ninety degrees (90°) as signified by arrow 77, would cause the massage roller 70 to vibrate up and down in plane of page. Furthermore, by clocking or offsetting the masses 72 and 74 by ninety degrees (90°) on their respective shafts would cause the massage roller 70 to vibrate to the left and right in the plane of the page. In certain embodiments, the solid hollow tube 78 may be surrounded by a foam or rubber type sleeve 71. The motor 76, sleeve 71 and casing have the properties described above with respect to other inventive embodiments. In embodiments of the inventive massage roller 70, vibration can be controlled in up to three directions, with the directions being controlled independently. It is appreciated that in certain inventive embodiments, such as that of FIGS. 10A and 10B that vibratory amplitude on the surface that varies less than 30 amplitude percent across the central 70 percent of the length is achieved that is circumferential around the casing or sleeve surface; or isolated to a radial portion of the cylindrical surface. Such radial vibratory amplitude is intended to be encompassed with definition of vibratory amplitude on the surface that varies less than 30 amplitude percent across the central 70 percent of the length as used throughout this document.

Figure 11A:
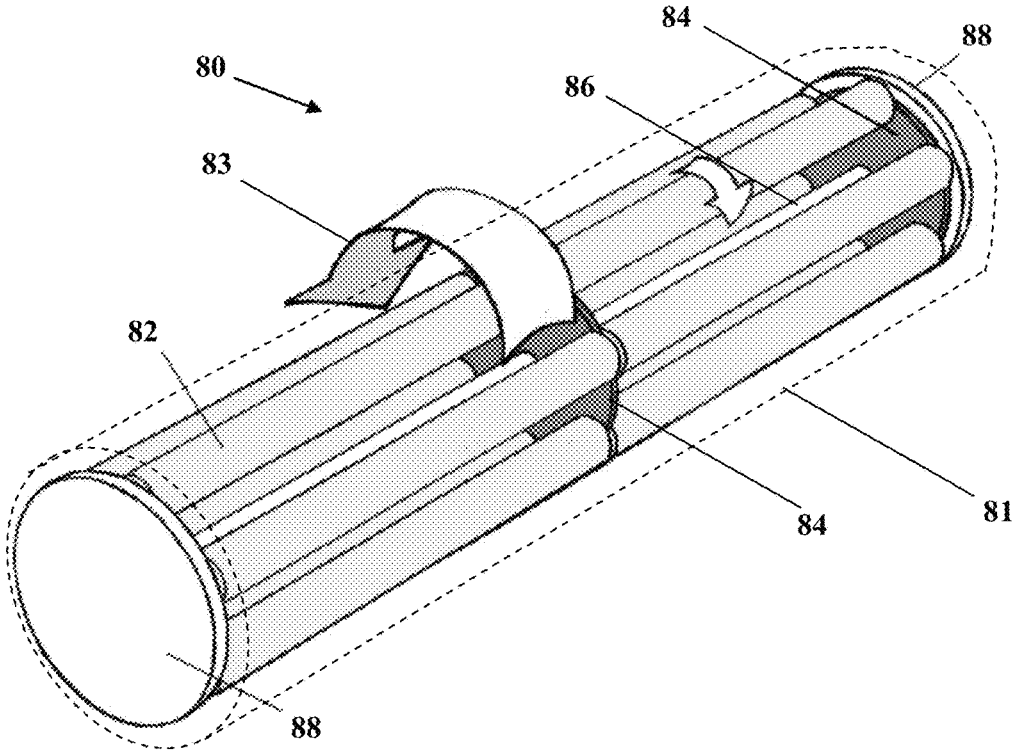
FIGS. 11A and 11B are perspective and sectional views, respectively of an inventive massage roller with rotating drum rollers that apply undulating displacement to subject muscles.
Figure 11B:
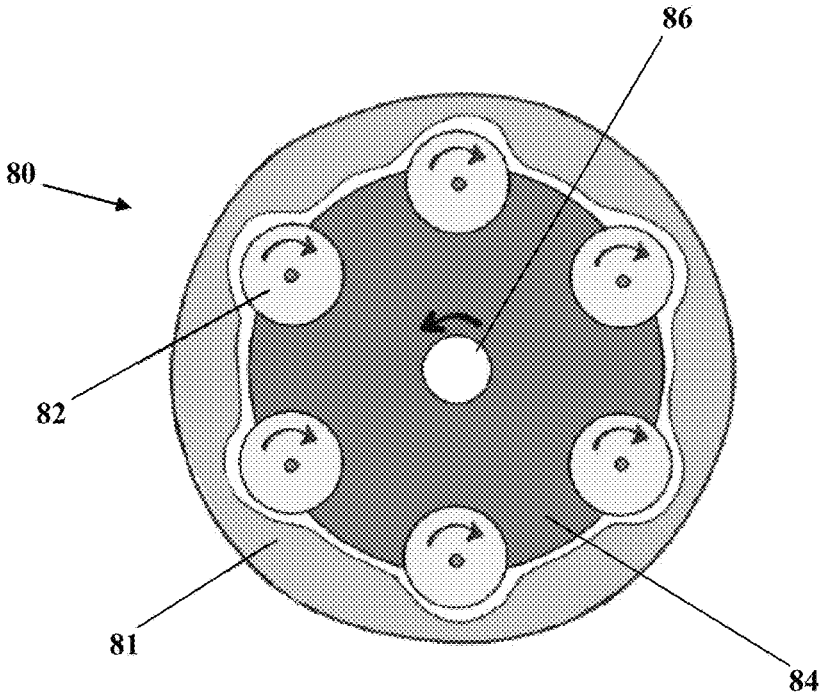

FIGS. 11A and 11B are perspective and sectional views, respectively of an inventive massage roller 80 with multiple rotating drum rollers 82 that apply undulating displacement to subject muscles. In the specific embodiment shown in FIG. 11B, a set of six thin drum rollers 82 are supported by three rotating bulkheads 84. As shown in FIG. 11B, the drum rollers 82 rotate clockwise about a central axial support 86, the axial support 86 fixedly attached to end supports 88. The end supports 88 have a slightly larger diameter than the rotating bulkheads 84 with rollers 82. The end supports 88 are not rotating, but roll on the floor. The bulkheads 84 rotating counter clockwise with respect to the central axial support 86. As shown by the large rotational arrow 83, the central portion of the massage roller 80 rotates at variable speeds relative to the ends. In a specific embodiment, a tight fitting rubber cover 81 (shown in dotted lines in FIG. 11A) is fitted over the roller 80, and the thin rollers roll on the inside of the rubber cover 81. It is to be understood that rotational directions may differ between specific embodiments of the inventive roller 80. Embodiments of the inventive roller 80 provide a vibratory amplitude to the surface that varies less than 30 amplitude percent across the central 70 percent of the length of the roller both circumferentially and longitudinally.

Figure 12A:
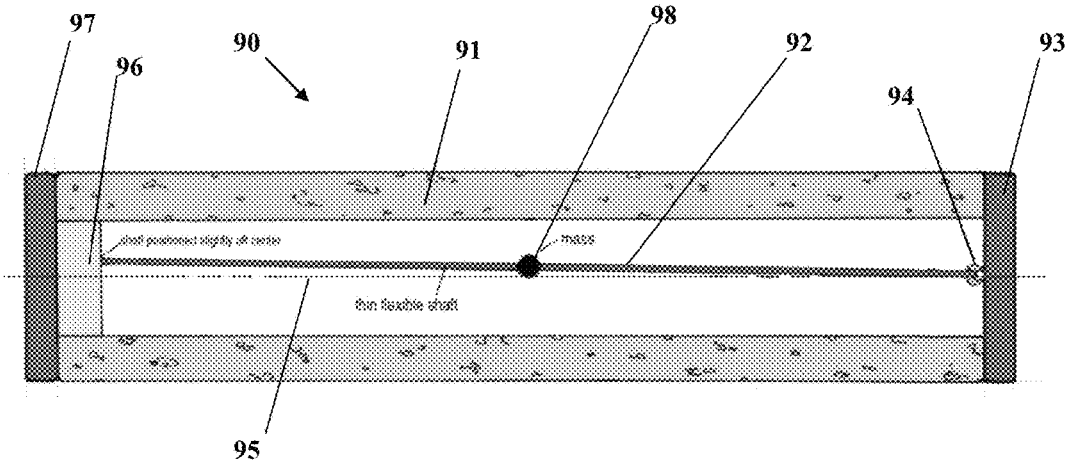
FIGS. 12A and 12B are longitudinal cross-sectional views of a massage roller with an offset rotating shaft in a stationary position and two temporally displaced positions, respectively.
Figure 12B:
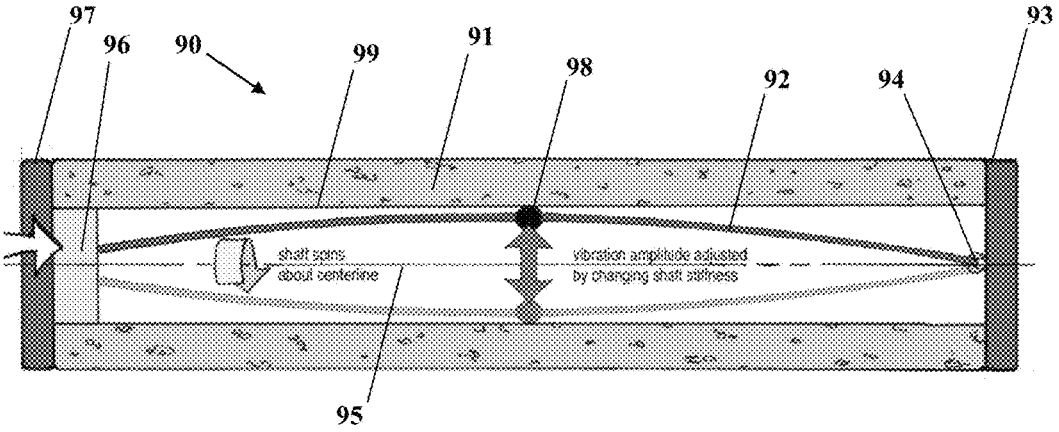

FIGS. 12A and 12B are side sectional views of a massage roller 90 with an offset rotating shaft 92 with a mass 98 mounted on the shaft 92. The offset rotating shaft 92 is attached to a swivel joint 94 that is positioned on the center line 95 that intersect the first end 93 and a second end 97. The swivel joint 94 is fixedly attached to the first end 93. A motor 96 at the second end 97 is joined to the shaft 92 at an offset to the center line 95. The rotation imparted to the shaft 92 with the mass 98 results in a wobbling action similar to a jump rope spun at one end. The vibration amplitude of the shaft 92 is determined by changing the stiffness of the shaft 92. In certain embodiments the shaft stiffness is adjusted at the second end 97. Embodiments of the inventive massage roller 90 allow a user to adjust amplitude at a constant frequency for a rotating imbalanced mass 98. The massage roller 90 has a tubular shell 99 surrounded by a sleeve 91. The motor 96, sleeve 91 and casing have the properties described above with respect to other inventive embodiments.

Patent documents and publications mentioned in the specification are indicative of the levels of those skilled in the art to which the invention pertains. These documents and publications are incorporated herein by reference to the same extent as if each individual document or publication was specifically and individually incorporated herein by reference.

Although the present invention has been described with reference to preferred embodiments, numerous modifications and variations can be made and still the result will come within the scope of the invention. No limitation with respect to the specific embodiments disclosed herein is intended or should be inferred.

The invention claimed is:

1. A process of massaging a subject comprising:

providing a vibratory massage roller, said massage roller comprising: a plastic cylindrical tubular casing having a surface extending over a length of said vibratory roller, the length being from 12 to 36 inches and extending from a first end to a second end of said cylindrical tubular casing, a single motor in said cylindrical tubular casing, said single motor coupled to an axle having a plurality of axially offset objects, said single motor electrically coupled to a power source and having symmetric weight distribution along the length of said vibratory roller;

energizing said power source to induce movement of said plurality of axially offset objects which are weighted and positioned to impart a vibratory amplitude to the surface such that the amplitude varies from 1 to 30 percent across the central 70 percent of the length of the vibratory massage roller and is circumferentially uniform about said cylindrical tubular casing for frequencies ranging from 20 to 4000 Hertz; and contacting said massage roller with the subject to massage the subject.

2. The process of claim 1 further comprising heating or cooling the massage roller.

3. The process of claim 1 further comprising placing a foam or rubber sleeve around said casing.

* * * * *